United States Patent [19]

Lambert, III

[11] 3,951,507

[45] Apr. 20, 1976

[54] ELECTRIC CONNECTOR APPARATUS

[75] Inventor: George L. Lambert, III, Lilburn, Ga.

[73] Assignee: Kearney-National, Inc., Atlanta, Ga.

[22] Filed: May 6, 1975

[21] Appl. No.: 574,918

[52] U.S. Cl. ..... 339/111; 339/DIG. 3; 339/143 R

[51] Int. Cl.[2] ..... H01R 13/52

[58] Field of Search ..... 339/111, DIG. 3, 143 R, 339/101

[56] References Cited

UNITED STATES PATENTS 3,617,987 11/1971 Sankey ..... 339/111

*Primary Examiner*—Roy Lake
*Assistant Examiner*—DeWalden W. Jones
*Attorney, Agent, or Firm*—Walter M. Rodgers; Walter A. Rodgers

[57] ABSTRACT

An electric terminal such as a transformer bushing having a contact socket of conducting material is provided with a quench tube arranged in aligned substantially coaxial relation with the contact socket. An associated connector which may be of the elbow type is provided with a contact pin which includes a tubular element of conducting material to the end of which a stem of mechanically strong plastic material is affixed to support a hollow sleeve disposed thereabout and formed of arc extinguishing material and which is bevelled at its outer end to facilitate entry of the contact pin into and through the quench tube and into the contact socket so as to form a connection between the contact socket and the tubular element of conducting material.

2 Claims, 3 Drawing Figures

ELECTRIC CONNECTOR APPARATUS

The nose portion of known contact pins which cooperate with known quench tubes associated with electric bushings are formed of highly efficient arc extinguishing material. Difficulties encountered in connection with elements formed of certain arc extinguishing materials are usually due to mechanical brittleness of the arc extinguishing material. Since connector apparatus is frequently subjected to heavy duty rough usage, elements formed of highly proficient arc extinguishing materials frequently are chipped or broken and hence rendered useless under many service conditions.

Plastic materials are known which are very strong mechanically and which are well adapted to withstand a high degree of mechanical stress. Unfortunately such strong materials are not well suited for use as arc extinguishing materials.

According to the present invention, advantage is taken of the highly proficient arc extinguishing characteristics of known arc extinguishing materials and also of known mechanically strong plastic materials and such materials are combined in such a way that compensation for the brittle characteristics of known proficient arc extinguishing materials is achieved by use of a mechanically strong plastic material which is not required to perform an arc extinguishing function. More specifically and according to the invention, the inner end of a contact pin is provided with a contact stem which is coaxially disposed with respect to the conducting part of the contact pin and is formed of mechanically strong plastic material and an outer sleeve of arc extinguishing material is disposed about the inner stem and its inner end is bevelled to facilitate entry into the quench tube 14.

Figure 1:
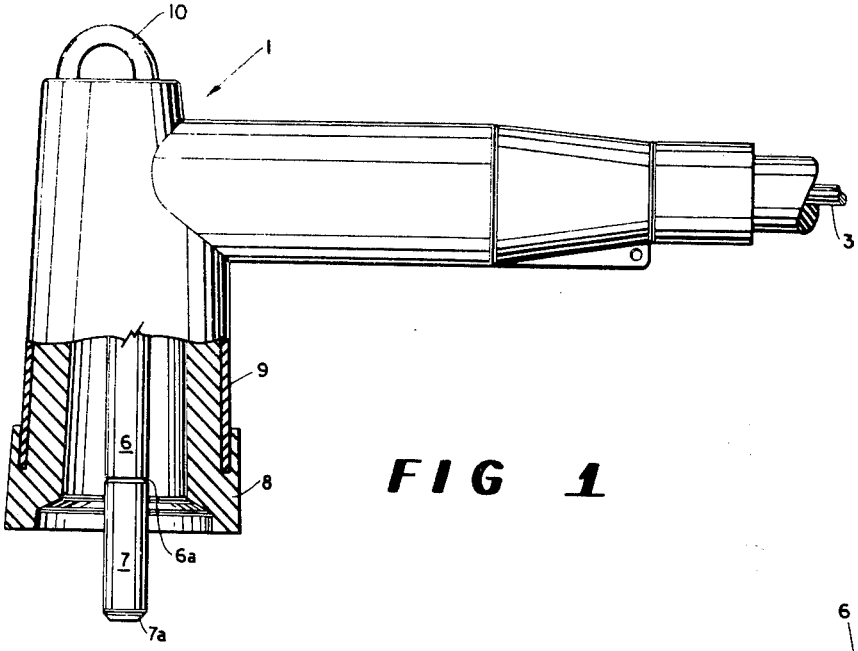
Figure 2:
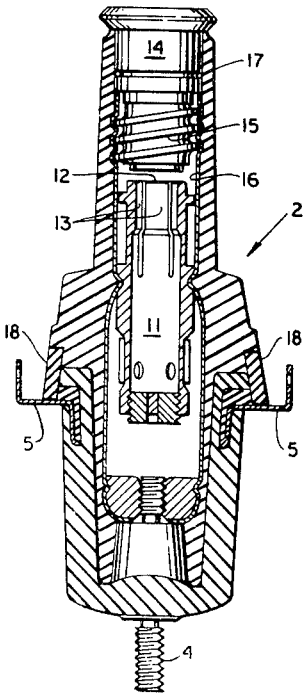
Figure 2:
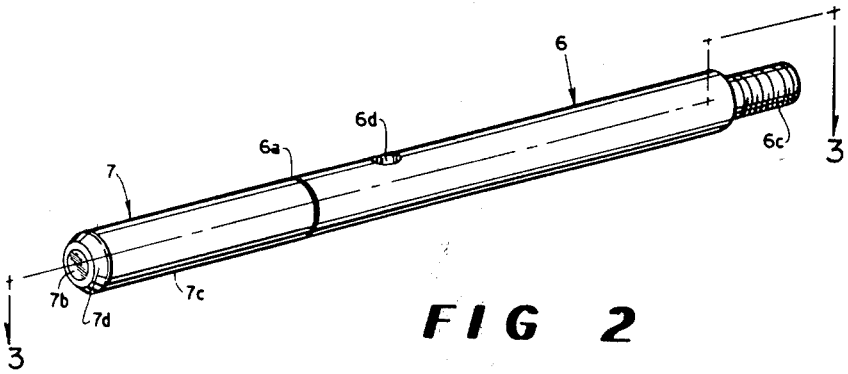
Figure 3:
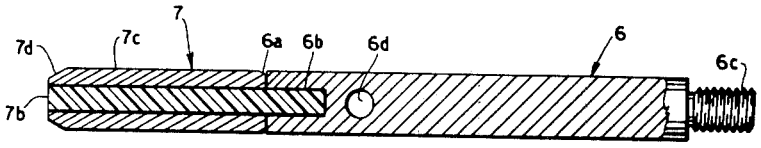

For a better understanding of the invention reference may be had to the following detailed description taken in conjunction with the accompanying drawings in which FIG. 1 is a view partially in section of a bushing connector and associated quench tube together with an elbow type connector with the parts shown in an open circuit position for clarity;

FIG. 2 is a perspective view of a contact pin constructed according to the invention; and in which FIG. 3 is a view partially in section taken along the line designated 3—3 in FIG. 2.

With reference to FIG. 1, the numeral 1 generally designates an elbow connector of conventional construction while the numeral 2 generally designates a bushing connector of conventional construction and which cooperates with the elbow connector 1 to form a connection between an outside conductor such as is designated by the numeral 3 and electric apparatus which may constitute a transformer winding, one terminal of which is designated by the numeral 4, the bushing 2 being mounted within an aperture formed in the transformer casing (not shown) and supported therein by suitable known support ring 5.

The elbow connector 1 comprises a contact pin having a rod-like or tubular conducting part 6 and a coaxially arranged part 7 formed of arc extinguishing material both of which are cylindrically configured together with insulating housing structure 8 about which is disposed elastomeric conducting material 9. A hook 10 is arranged to receive an end of a clamp stick by which the connector 1 is manipulated.

The bushing connector 2 comprises a contact socket 11 the upper end 12 of which is open. Slots are formed in the sides of contact socket 11 to define a plurality of fingers 13 so as to render the upper end of the contact socket expandable for receiving the contact pin 6, 7.

The quench tube 14 is provided with exterior threads 15 which cooperate with internal threads formed within the support structure comprising inner metallic conductive sleeve 16 which is received within a cavity formed within insulating housing support 17. Insulating housing support 17 is provided with elastomeric conducting material 18 which is grounded to bracket 5 and in turn to the tank of the associated apparatus such as a transformer.

In order to complete a circuit between conductors 3 and 4, the elbow connector 1 is manipulated in such a manner as to cause the skirt 8 to envelope the housing support structure 17 and so as to cause the arc extinguishing part 7 to pass through the quench tube 14 and downwardly into the contact socket 11. Of course when the lower end **6*a* of the conducting tube 6 enters the open end of contact socket 11 and engages the contact fingers 13**, the circuit is complete.

When the connector 1 is withdrawn, an arc is established between the end portion **6*a* of conducting portion 6 of the contact pin as the lower end 6*a* clears the upper end 12 of the contact socket 11. The arc is extinguished by arc extending portion 7 of the contact pin and by the quench tube 14**.

The quench tube 14 is formed of arc extinguishing material which is very effective in extinguishing electric arcs.

The contact pin shown in FIGS. 2 and 3 is constructed according to the invention and comprises a tubular conducting part 6 to the inner end **6*a* of which is secured a stem 7*b* formed of mechanically strong plastic material. The stem 7*b* is firmly secured within a recess 6*b* formed within the conducting part 6 of the contact pin. This securement may be by means of threads, adhesive or by any other suitable means. Disposed about the stem 7*b* is a sleeve 7*c* formed of arc extinguishing material. Since arc extinguishing material is mechanically brittle, and because the stem 7*b* is mechanically strong but formed of material which is not particularly effective as an arc extinguishing material, the result is a mechanically strong highly effective arc extinguishing structure. According to one aspect of the invention, the inner end of sleeve 7*c* is bevelled as indicated at 7*d* to facilitate entry of part 7 into quench tube 14 and contact socket 11. The threaded end 6*c* of conducting tubular structure 6 is threaded into a suitable conductor such as a contact block as disclosed and claimed in U.S. Pat. No. 3,768,065 granted Oct. 23, 1973. The aperture 6*d* in conductive pin 6** is simply for the purpose of receiving a part of a tightening tool whereby the contact pin is screwed into the contact block.

From the above description, it is apparent that by the invention a contact pin is constructed in such manner as to take advantage of the arc extinguishing properties of the brittle sleeve such as **7*c* and advantage is also taken of the strong mechanical properties of the plastic stem such as 7*b***.

The embodiments of the invention in which an exclusive property or privilege is claimed are defined as follows:

1. A contact pin constituting a component of an electric connector apparatus, said contact pin comprising a tubular pin of conducting material, a stem of mechanically strong plastic material secured to the end of said tubular pin which is subjected to arcing and arranged in coaxial relation therewith, and a hollow tubular sleeve of arc extinguishing material disposed about and secured to said stem and in coaxial relation therewith and having one end in snug engagement with the adjacent end of said tubular pin of conducting material.

2. A contact pin according to claim 1 wherein the other end of said hollow tubular sleeve is bevelled externally.

* * * * *